US009382096B2

(12) United States Patent
Finschi

(10) Patent No.: US 9,382,096 B2
(45) Date of Patent: Jul. 5, 2016

(54) ELEVATOR INSTALLATION ACCESS SECURITY METHOD WITH POSITION DETECTION

(71) Applicant: Inventio AG, Hergiswil (CH)

(72) Inventor: Lukas Finschi, Lucerne (CH)

(73) Assignee: Inventio AG, Hergiswil (CH)

( * ) Notice: Subject to any disclaimer, the term of this patent is extended or adjusted under 35 U.S.C. 154(b) by 400 days.

(21) Appl. No.: 14/101,411

(22) Filed: Dec. 10, 2013

(65) Prior Publication Data

US 2014/0097046 A1 Apr. 10, 2014

Related U.S. Application Data

(60) Continuation of application No. 13/660,336, filed on Oct. 25, 2012, now Pat. No. 8,684,142, which is a division of application No. 13/274,626, filed on Oct. 17, 2011, now Pat. No. 8,381,880, which is a continuation of application No. 12/088,277, filed on Sep. 3, 2008, now Pat. No. 8,061,485.

(51) Int. Cl.

| | |
|---|---|
| ***B66B 1/20*** | (2006.01) |
| ***B66B 1/48*** | (2006.01) |
| ***B66B 1/46*** | (2006.01) |

(52) U.S. Cl.

CPC . *B66B 1/48* (2013.01); *B66B 1/468* (2013.01); *B66B 2201/463* (2013.01); *B66B 2201/4615* (2013.01); *B66B 2201/4676* (2013.01)

(58) Field of Classification Search

CPC .. B66B 1/48; B66B 1/468; B66B 2201/4615; B66B 2201/463; B66B 2201/4676

USPC ..... 187/247, 380–389, 391–396

See application file for complete search history.

(56) References Cited

U.S. PATENT DOCUMENTS

| | | | | |
|---|---|---|---|---|
| 4,341,288 | A | | 7/1982 | Bass |
| 4,534,056 | A | | 8/1985 | Feilchenfeld et al. |
| 4,662,479 | A | | 5/1987 | Tsuji et al. |
| 4,839,631 | A | | 6/1989 | Tsuji |
| 4,979,594 | A | | 12/1990 | Begle et al. |
| 5,159,163 | A | | 10/1992 | Bahjat et al. |
| 5,200,583 | A | | 4/1993 | Kupersmith et al. |
| 5,689,094 | A | | 11/1997 | Friedli et al. |
| 5,749,443 | A | * | 5/1998 | Romao ..... B66B 1/468 187/384 |
| 5,914,671 | A | | 6/1999 | Tuttle |
| 5,932,853 | A | | 8/1999 | Friedli et al. |
| 5,952,626 | A | | 9/1999 | Zaharia |
| 6,011,839 | A | | 1/2000 | Friedli et al. |
| 6,057,764 | A | | 5/2000 | Williams |

(Continued)

FOREIGN PATENT DOCUMENTS

| | | |
|---|---|---|
| AU | 2004233443 B1 | 3/2005 |
| DE | 10102936 A1 | 7/2002 |

(Continued)

*Primary Examiner* — Anthony Salata

(74) *Attorney, Agent, or Firm* — Fraser Clemens Martin & Miller LLC; William J. Clemens

(57) ABSTRACT

Using a position detection device, a position of a user in a building area outside of an elevator system is detected. It is determined, after the user has entered an elevator car, that the user is not authorized to travel to a destination floor designated by a destination for the user. As a result of the determination, the elevator car is moved to an area other than the destination floor.

20 Claims, 2 Drawing Sheets

(56) References Cited

U.S. PATENT DOCUMENTS

| | | | | |
|---|---|---|---|---|
| 6,202,799 | B1 | 3/2001 | Drop | |
| 6,209,685 | B1 | 4/2001 | Zaharia et al. | |
| 6,354,405 | B1 | 3/2002 | Svensson-Hilford et al. | |
| 6,397,976 | B1 | 6/2002 | Hale et al. | |
| 6,707,374 | B1 | 3/2004 | Zaharia | |
| 6,720,874 | B2 | 4/2004 | Fufido et al. | |
| 6,772,862 | B2 | 8/2004 | Friedli | |
| 6,892,861 | B2 | 5/2005 | Friedli | |
| 7,093,693 | B1 | 8/2006 | Gazdzinski | |
| 7,119,658 | B2 | 10/2006 | Stilp | |
| 7,190,256 | B2 | 3/2007 | Pieper | |
| 7,328,775 | B2 | 2/2008 | Zaharia et al. | |
| 7,330,114 | B2 | 2/2008 | Finlayson | |
| 7,353,915 | B2 | 4/2008 | Zaharia et al. | |
| 7,500,544 | B2 | 3/2009 | Hakala et al. | |
| 7,581,622 | B2 | 9/2009 | Amano | |
| 7,711,565 | B1 | 5/2010 | Gazdzinski | |
| 7,717,238 | B2 | 5/2010 | Hamaji et al. | |
| 7,729,691 | B2 | 6/2010 | Newville | |
| 7,823,700 | B2 | 11/2010 | Boss et al. | |
| 7,882,938 | B2 | 2/2011 | Blackaby et al. | |
| 8,020,672 | B2 * | 9/2011 | Lin | B66B 1/34 187/316 |
| 8,061,485 | B2 * | 11/2011 | Finschi | B66B 1/468 187/384 |
| 8,413,767 | B2 | 4/2013 | Nakashima | |
| 8,464,840 | B2 * | 6/2013 | Flynn | B66B 1/468 187/384 |
| 8,490,754 | B2 * | 7/2013 | Amano | B66B 1/2458 187/384 |
| 9,079,751 | B2 * | 7/2015 | Sundholm | B66B 1/2458 |
| 9,238,568 | B2 * | 1/2016 | Nonami | B66B 1/468 |
| 9,272,877 | B2 * | 3/2016 | Nakashima | B66B 1/34 |
| 2003/0098776 | A1 | 5/2003 | Friedli | |
| 2003/0116384 | A1 | 6/2003 | Friedli | |
| 2004/0188185 | A1 | 9/2004 | Pieper | |
| 2008/0217112 | A1 | 9/2008 | Puskala et al. | |
| 2011/0127117 | A1 | 6/2011 | Amano | |
| 2011/0168498 | A1 | 7/2011 | Amano | |
| 2012/0037458 | A1 | 2/2012 | Gerstenkorn | |
| 2012/0160613 | A1 | 6/2012 | Friedli | |
| 2014/0305747 | A1 * | 10/2014 | Kumar | B66B 1/468 187/381 |

FOREIGN PATENT DOCUMENTS

| | | | |
|---|---|---|---|
| DE | 10227601 | A1 | 1/2004 |
| DE | 102004042999 | A1 | 3/2006 |
| EP | 0699617 | B1 | 5/2000 |
| EP | 1110899 | A1 | 6/2001 |
| EP | 1295838 | A1 | 2/2003 |
| EP | 1475754 | A1 | 11/2004 |
| JP | 1181687 | A | 7/1989 |
| JP | 5139631 | A | 6/1993 |
| JP | 65332 | A | 2/1994 |
| JP | 2002504468 | A | 2/2002 |
| JP | 2004010303 | A | 1/2004 |
| JP | 2004262619 | A | 9/2004 |
| JP | 2004315127 | A | 11/2004 |
| JP | 2005206309 | A | 8/2005 |
| WO | 00/40496 | A1 | 7/2000 |
| WO | 03/027966 | A2 | 4/2003 |

* cited by examiner

ELEVATOR INSTALLATION ACCESS SECURITY METHOD WITH POSITION DETECTION

CROSS-REFERENCE TO RELATED APPLICATION

This application is a continuation of the co-pending U.S. patent application Ser. No. 13/660,336 filed Oct. 25, 2012, which is a divisional of U.S. patent application Ser. No. 13/274,626 filed Oct. 17, 2011, now U.S. Pat. No. 8,381,880, which is a continuation of U.S. patent application Ser. No. 12/088,277 filed Sep. 3, 2008, now U.S. Pat. No. 8,061,485.

FIELD OF THE INVENTION

The invention relates to a method of operating an elevator installation for transporting elevator users in a building area. Moreover, the invention relates to an elevator installation for carrying out the above method.

BACKGROUND OF THE INVENTION

An elevator installation with a recognition device is known from EP 0 699 617 B1, in which an elevator user carries an information transmitter which is interrogated by recognition devices mounted at the entrance to the elevators. The data stored on the information transmitter are passed on to the elevator control in order to control the elevator in correspondence with the stored data.

A control device for transporting persons/goods with the help of user profiles is described in EP 1 295 838 A1. Individual transport preferences of the persons/goods are stored in the user profiles of the control unit. A recognition device which recognizes an identification code of a person or item of goods is provided. A user profile of the person or item of goods to be transported is provided for each recognized identification code. The elevator installation is controlled in drive by a control device. This drive control is based in parts on the user profile and comprises multiple elevator-specific details such as the boarding floor and destination floor of the person or item of goods to be transported. However, it is not possible to establish whether the person or item of goods to be transported is actually transported in accordance with the user profile.

The users of the elevator installation are not only persons, but also goods and are termed elevator users in the following.

In building areas having a plurality of elevators an allocation of the elevators to individual elevator users is frequently undertaken by way of a destination call control. The elevator users then no longer have to activate a car call. It is known to arrange an access check at the entrance of building areas of that kind in order to grant access to such elevator users which can identify themselves and in order to deny access to other elevator users which cannot identify themselves. However, building areas frequently have public and private regions or regions internal to companies so that at the entrance of the building area there are let in not only elevator users which have access to the private regions in the building area, but also elevator users which have access only to the public regions. The control and checking of the access authorizations in the building areas is thus not simple to realize.

The continued stay or also the movement of the elevator users in the respective building area can now be monitored only with a high level of cost. Thus, for example, it is possible that a non-authorized elevator user at the same time enters an elevator car, which travels to a private region, and thus gains access to the private regions. Securing of these private regions for cases of that kind was previously possible only by expensive monitoring or by further access checks in the private regions. Such safeguards require a trained, often armed, security service as well as special and substantial devices. All this is intimidating and regarded as unpleasant.

SUMMARY OF THE INVENTION

It is accordingly the elevator user of the invention to indicate, in a building area which has regions with different access authorizations, an elevator installation and a method by which the stay of elevator users in the building area can be monitored and checked without substantial cost in order to enable an effective drive control of the elevator installation or intervention of a security service.

An elevator user to be transported in the building area can for starting transport by the elevator installation trigger either a destination call or a combination of an elevator call with a car call. A car call is a call in which only the boarding location is communicated to an elevator control. The elevator control allocates an elevator car to the corresponding elevator user. After boarding of the car the elevator user triggers a car call in the car. The car call is communicated to the elevator control and the car thereupon transports the elevator user from the boarding location to the appropriate floor corresponding with the destination floor of the car call. A destination call is a call in which not only the boarding location, but also the destination location are transmitted to an elevator control. The elevator control allocates to the corresponding elevator user an elevator car which transports this elevator user from the boarding location to the appropriate floor corresponding with the destination location of the destination call and this without a further car call being triggered by the elevator user.

The core of the invention is detection of the position of the elevator users in the building area. If a destination call or elevator call is triggered by a detected elevator user and if this destination call or elevator call is served by an associated elevator car the position of a detected elevator user, which has boarded an elevator car, is compared with the position of that elevator user which has triggered the destination call or elevator call. If the elevator user has triggered an elevator call, it triggers a car call in the car. Moreover, the invention is based on granting to the elevator users access authorizations to building regions. Thus, it is checked in the elevator car whether the detected elevator user has an access authorization for a destination floor corresponding with the destination call or car call.

In an advantageous embodiment of the invention it is possible to check whether all elevator users which are transported in an elevator car have also triggered a destination call or elevator call. If an elevator user does not have an appropriate access authorization for the destination floor a security measure can be triggered and if it is established that there is located in the elevator car an elevator user which has not triggered a destination call or elevator call a security measure is similarly triggered.

In particular, it is advantageous if the elevator user triggering a destination call or elevator call has to identify itself. This can take place, for example, by way of an input keyboard into which a code is input. Alternatively, this can be undertaken in wire-free manner by way of a chipcard. The identification is also possible through input of a password by way of an input terminal. In addition to identification, an authentication is also possible. This counter-check or authentication increases the security in the building area. For example, the authentication is carried out by biometric recognition systems of a face, an iris, a fingerprint, the speech, etc. It is particularly advantageous if the elevator user triggering a destination call or elevator call not only identifies itself, but is also authenticated. If need be, the identification and the authentication can take place in one step.

It is particularly advantageous in a further embodiment of the invention if the number of elevator users, which have triggered a destination call or elevator call and have been detected in their position, is determined and compared with the number of elevator users, which have boarded an elevator car. It can thus be checked whether a difference exists between the numbers. If the number of elevator users, which have triggered a destination call or elevator call or were detected, should differ from the number of elevator users, which have boarded an elevator car, an increased security risk exists.

It is particularly advantageous if in the case of non-agreement of the position of the elevator user, which has boarded the elevator car, with the position of the elevator user, which has triggered a destination call or elevator call and is served by the elevator, a security measure is undertaken. This security measure can, for example, follow up monitoring of the floors concerned by installed security cameras. Another possibility is personal checking of the floors concerned by security forces.

Further possibilities consist in influencing the elevator control and in a given case no longer travelling to regions in the building area having a high security grade. Thus, non-authorized elevator users are effectively prevented from accessing these high-security regions.

In the case of detection of the position of elevator users, there can be detection not only of the position in space, but also a position in time of an elevator user in a building area. The position in space can in that case be triggered at different levels. Thus, in the simplest case it can contain information about the plane on which an elevator user is located. However, it is equally possible to divide a plane into several sectors and to additionally add to the plane information also sector information. The position in time of an elevator user can be detected alternatively or also in combination with the position in space. It can thus be established, for example, when an elevator user has entered a building area at a point in time and, if after a fixedly preset period in time has not actuated a destination call or elevator call, this elevator user possibly remains without authorization somewhere in another building region. Moreover, it is thus possible to assign increased monitoring to elevator users, to which access to the building sections is granted only in a specific time window, at times in which they normally do not have access to the building area.

The elevator users can be persons or goods. The goods are preferably transported by persons. Through monitoring a transported item of goods it can be ensured that the corresponding goods can be transported only into the building planes intended for that purpose.

The elevator user is also fulfilled by an elevator installation comprising several elevator cars. Moreover, a position detection device is arranged at the building entrance and/or in the building area and/or in elevator cars. The elevator installation comprises input terminals for input of a destination call. Moreover, an elevator control for controlling the individual elevator cars is provided. A main control unit is connected not only with a detection unit, but also with an identification unit, an access authorization unit, input terminals for elevator calls and the elevator cars.

DESCRIPTION OF THE DRAWINGS

The invention is explained in more detail in the following by way of examples of embodiment which are illustrated in schematic manner in the drawings, in which.

DESCRIPTION OF THE PREFERRED EMBODIMENT

Figure 1:
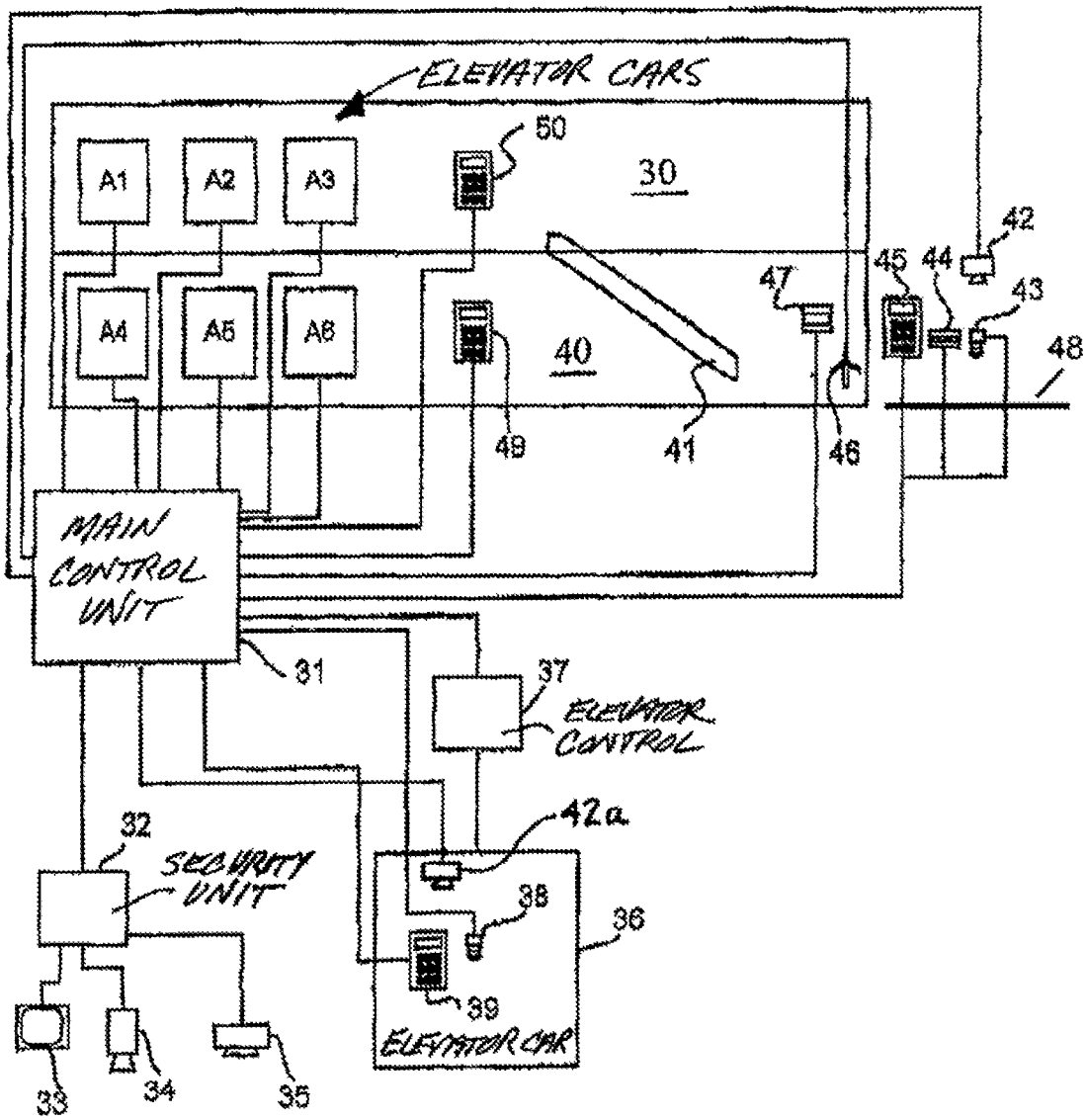
FIG. 1 shows a schematic illustration of an elevator installation according to the present invention.

The elevator installation according to the invention is located in a building area. The building area is either a building with several planes such as an office building, a hospital, a shopping center, etc., or it is a complex consisting of several such buildings, such as a factory site, a sports installation, etc. The elevator installation comprises several elevators with one or more elevator cars A1 to A6 per elevator shaft. The elevator shaft runs through several planes 30, 40 of the building area. Accesses to the elevator shaft are located in the different planes of the building area. In FIG. 1 the accesses to the elevator cars A1 to A3 are arranged in the second plane 30 and the accesses to the elevator cars A4 to A6 are arranged in the first plane 40. The individual planes are also connected together, for example, by way of moving walkways 41 and staircases.

At least one input terminal 49, 50 for the input of elevator calls is provided in each plane 30, 40. These input terminals 39, 50 contain, for example, an input keyboard and a display for indicating an allocated elevator car serving the destination call or elevator call. The input terminals are advantageously arranged near the accesses to the elevators. The input terminals 49, 50 are connected by way of electronic data lines with a main control unit 31 of the elevator installation. The elevator calls are thus communicated to the main control unit 31.

Moreover, a position detection device is arranged in the building area and in the simplest case is realized by a camera 42 in an entry region of the building area. In the normal case the position detection device consists of a number of such cameras, which are mounted everywhere in the building area. Advantageously, all routes accessible to elevator users in the building area are detected by cameras. In that case each camera has a specific detection range. Adjacent cameras are so arranged that their detection range overlaps at least in regions. An elevator user which moves from a first detection range to an adjacent second detection range is thus initially detected only by the first camera, as soon as it crosses through an overlap region it is detected by both cameras and thereafter is detected only by the second camera. Advantageously, the cameras are connected with an evaluating unit and a storage medium. The detected elevator user positions are evaluated by the evaluating unit and fixed on the storage medium as spatial and time position data. It is possible through evaluation of the camera signals to continuously check where an elevator user is just located in the building area. Conventional digital liquid-crystal display (LCD) cameras are suitable for the elevator user detection, but also movement sensors such as infrared (IR) detectors or radar sensors and ultrasound sensors can be used. The evaluating unit can be a standard computer unit with a program for recognition of camera signals in the form of digital images. Such a recognition program allows, for example, distinction of different elevator users on a camera image. Distinction criteria are the color, size and shape of elevator users or also the differences, which can be established by image comparison, between images of different cameras or between images which were recorded at different points in time. Thus, the number of elevator users per camera image can be determined. In addition, such a recognition program allows determination of the movement direction and speed of elevator users on camera images. Several such recognition programs are commercially available.

An identification unit comprises, for example, an input terminal 45 with a numeric keyboard or a card reader 44. An alternative embodiment comprises a wireless chipcard reader 43 which can, for example, interrogate codes, which are stored on radio-frequency identification (RFID) chips and which are carried by the elevator users. An elevator user is identified by way of these codes which are exchanged in that manner and which are either input or read by the card or the RFID chip. After an identification by means of the identification unit access to the building area is granted via opening doors or released turnstiles 46. In the case of an identification or after an elevator user access to the building area has been achieved, an access authorization is allocated to the elevator user by means of the access authorization unit.

Moreover, the elevator installation comprises a main control unit 31 with which all components of the elevator installation are connected. The main control unit can also be realized by co-operation of several distributed control units. The main control unit 31 is coupled with a security unit 32 which has several monitors 33, loudspeaker units 34 and camera systems 35. The camera and loudspeaker system 34, 35 can be distributed over the planes 30 and 40 or further planes in the building area.

In addition, a detail view of an elevator car A1-A6 is schematically illustrated in FIG. 1. The elevator car 36 is coupled with the main control unit 31. An input terminal 39 with a numeric keyboard and an indicating display is similarly disposed in the elevator car 36. An RFID chip reader 38 represents an alternative. The elevator car 36 is controlled by an elevator control 37, wherein the elevator control 37 similarly receives its commands from the main control unit 31. The main control unit 31 conducts to each elevator a user profile with all necessary data for operation of the elevator. Thus, a user profile comprises constantly updated details about the number of elevator calls which are associated with the elevator car 36. With respect to each elevator call the user profile registers the boarding and destination planes and also the point in time at which the destination call or elevator call was triggered. In addition, the user profile indicates the sequence in which the elevator cars 36 are moved to the destinations. It is therefore particularly advantageous if also the position data and the access authorization of each elevator user are communicated to the main control unit 31 and filed in the user profile. The main control unit 31 can thus assign, to each destination call or elevator call actuated at an input terminal 49, 50, exactly one elevator user position current in terms of time and an access authorization of the elevator user. For this purpose the position detection device and the main control unit 31 are connected together by way of an electronic data line, for example a bus system or a network.

Figure 2:
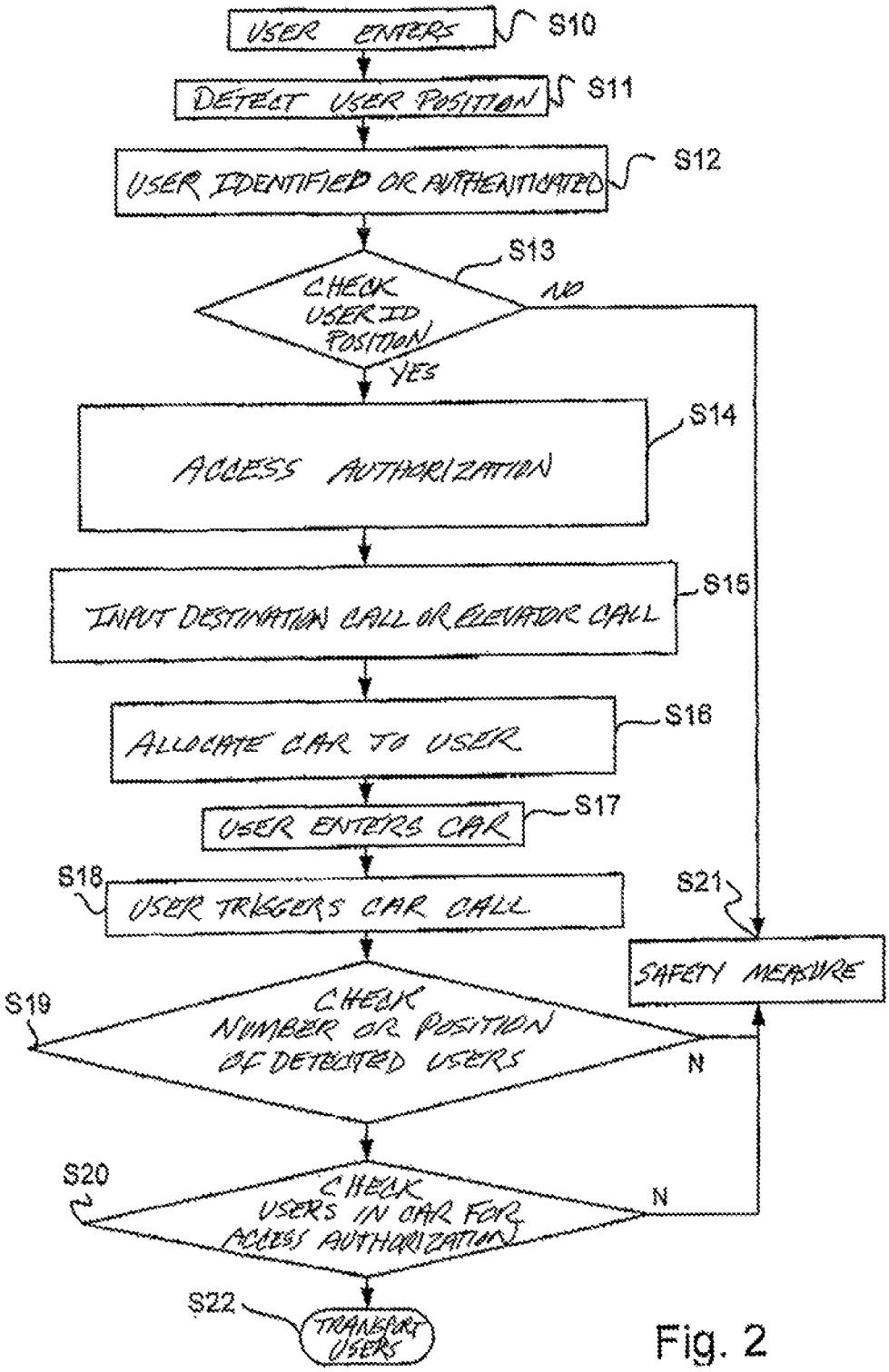
FIG. 2 shows a flow chart for a method according to the present invention.

A method according to the invention is explained in the following according to FIG. 2. After an elevator user in the form of a person or an item of goods to be transported has entered the building area or was brought into the building area S10, the position of the elevator user is detected in step S11. After the position was detected, for example by way of the camera 42 in a building area such as an elevator lobby 48, S11 the elevator user is identified or authenticated S12. This identification or authentication takes place, for example, by way of an input terminal 45, a chipcard reader 44 or a wireless RFID chip interface 43. For authentication of the elevator user, for example, a biometric recognition system detects from the elevator user a face, an iris, a fingerprint, speech, etc. In step S13 it is checked whether the elevator user has been correctly identified or authenticated and whether its position was detected. If the elevator user was not identified or authenticated or its position was not detected, a safety measure S21 is initiated. This safety measure S21 can comprise, for example, the entry doors or turnstiles 46 or other kinds of barriers being blocked or remaining blocked in order to prevent forcible incursion of an unauthorized elevator user. After the elevator user has been correctly identified or authenticated and its position detected it is granted an access authorization in step S14. In the simplest case this can be opening of a door or release of a turnstile 46.

After the elevator user has correctly entered the building area, it can move, for example, from a first plane 40 by way of an escalator 41 to another plane, for example a second plane 30. In that case the current position of the elevator user is constantly ascertained by the position detection device. Depending on the plane 30, 40 in which the elevator user is disposed, in step S15 a destination call or elevator call can be input at an input terminal 49, 50 in the corresponding plane. This destination call or elevator call is input, for example, by way of a numeric keyboard and transmitted to the main control unit 31. The main control unit 31 then allocates to the elevator user in step S16 an elevator car which is disposed on the corresponding plane and is represented by, for example, the input terminal 49 or 50 in a display.

In step S17 the detected elevator user enters the elevator car allocated thereto.

If the elevator user has triggered not a destination call, but an elevator call, the elevator user in step S18 triggers a car call in the elevator car.

Advantageously, in step S19 the number or position of the detected elevator users in the elevator car is checked. This advantageously takes place by the recognition program of the position detection device camera 42*a* positioned in the elevator car 36 and connected to the control unit 31. If the number of elevator users disposed in the elevator car does not, for example, agree with the number of elevator users allocated to this elevator car a security measure S21 can be triggered. Alternatively or additionally, a security measure can be triggered in step S19 when the position of the elevator user in the elevator car does not agree with the position of that elevator user which has activated the destination call or elevator call. In the case of a security measure, a security department is informed in that, for example, the monitors 33 in the security department are directly switched over to the planes concerned and a detectable report is issued in the safety department.

In step S20 it is checked whether all detected elevator users transported in the elevator car also have an access authorization for the destination location. If an elevator user does not have such an access authorization, a security measure S21 can again be triggered. Alternatively or additionally to the security measure S21 it is possible to so influence the elevator control 37 by way of the main control unit 31 that the elevator car 36 does not travel to the planes with high-security relevance. Another possibility is to block the elevator car so that elevator users located in this elevator car cannot disembark. A further possibility is to convey the elevator car directly back again to the public region and allow the elevator users to disembark. Another possibility is to move the elevator car to a security stop where a check can be carried out by security personnel.

In step S22 elevator users detected and checked in that manner are transported by the elevator car 36 to the destination locations.

An increase in security in building areas is possible with the present invention. In particular, it is possible to prevent unauthorized movement of elevator users from public regions to private regions. Through the possibility of influencing the elevator cars security measures can be taken effectively and at good time and thus access of non-authorized elevator users to high-security regions prevented.

Moreover it is possible to selectively influence the elevator control 37 by way of the main control unit 31 so that there is taken into consideration exactly that control data which corresponds with the elevator users located in the car. Thus, for example, it is possible to enable an improved elevator operation if not all elevator users, which are assigned to the elevator, have entered the elevator in that, for example, there is movement to only precisely those destinations which correspond with the elevator users actually transported.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method, comprising:

detecting, using a position detection device, a position of a user at a building area outside of an elevator car;

determining, after the user has entered the elevator car, that the user is not authorized to travel to a destination floor designated by a destination call for the user; and as a result of the determining, moving the elevator car to an area other than the destination floor.

2. The method of claim 1, the position detection device comprising a camera.

3. The method of claim 2, the position detection device comprising a plurality of cameras, the detecting the position of the user comprising tracking the user as the user moves from a first region to a second region.

4. The method of claim 1, further comprising:

determining a number of passengers currently in the elevator car; and based on the determined number of passengers, performing a security measure.

5. The method of claim 4, the security measure comprising monitoring a building floor using a security camera.

6. The method of claim 4, the security measure comprising issuing a report to a safety department.

7. The method of claim 1, the building area outside of the elevator car comprising an elevator lobby.

8. The method of claim 1, the area other than the destination floor comprising a public building region.

9. The method of claim 1, the area other than the destination floor comprising a security stop.

10. The method of claim 1, the area other than the destination floor comprising a non-high-security area.

11. The method of claim 1, the determining that the user is not authorized to travel to the destination floor designated by the destination call for the user being based on a current time.

12. A system, comprising:

a position detection device, the position detection device being positioned in a building area outside of an elevator car; and a computer-based control unit that, when activated, performs a method, the method comprising, detecting, using a position detection device, a position of a user at a building area outside of an elevator car, determining, after the user has entered the elevator car, that the user is not authorized to travel to a destination floor designated by a destination call for the user, and as a result of the determining, moving the elevator car to an area other than the destination floor.

13. The system of claim 12, the position detection device comprising a camera.

14. The system of claim 12, the position detection device comprising a chip reader.

15. The system of claim 12, the position detection device comprising a radio frequency identification tag reader.

16. The system of claim 12, the building area comprising a lobby.

17. The system of claim 12, further comprising the elevator car, the system being an elevator installation.

18. The system of claim 12, the user comprising goods.

19. A computer-based control unit, comprising:

a processor; and a computer-readable storage medium having encoded thereon instructions that, when executed by the processor, cause the processor to perform a method, the method comprising, detecting, using a position detection device, a position of a user at a building area outside of an elevator car, determining, after the user has entered the elevator car, that the user is not authorized to travel to a destination floor designated by a destination call for the user, and as a result of the determining, moving the elevator car to an area other than the destination floor.

20. A computer-readable storage medium having encoded thereon instructions that, when executed by a computer, cause the computer to perform a method, the method comprising:

detecting, using a position detection device, a position of a user at a building area outside of an elevator car;

determining, after the user has entered the elevator car, that the user is not authorized to travel to a destination floor designated by a destination call for the user; and as a result of the determining, moving the elevator car to an area other than the destination floor.

* * * * *